US007478800B2

(12) United States Patent
Keller et al.

(10) Patent No.: US 7,478,800 B2
(45) Date of Patent: Jan. 20, 2009

(54) ANTI-BACK-STREAMING CARBURETOR VALVE

(75) Inventors: Duncan Adam Keller, Los Gatos, CA (US); Arthur Langlie, San Jose, CA (US)

(73) Assignee: Central Coast Patent Agency, Inc., Watsonville, CA (US)

( * ) Notice: Subject to any disclaimer, the term of this patent is extended or adjusted under 35 U.S.C. 154(b) by 341 days.

(21) Appl. No.: 11/368,286

(22) Filed: Mar. 3, 2006

(65) Prior Publication Data

US 2006/0196470 A1 Sep. 7, 2006

Related U.S. Application Data

(60) Provisional application No. 60/658,999, filed on Mar. 4, 2005.

(51) Int. Cl.
*F02M 17/38* (2006.01)

(52) U.S. Cl. ..... 261/38; 251/315.01; 261/64.1; 261/DIG. 74; 261/DIG. 83

(58) Field of Classification Search ..... 261/38, 261/64.1, DIG. 74, DIG. 83; 251/129.2, 251/208, 286, 315.01, 315.05–315.08
See application file for complete search history.

(56) References Cited

U.S. PATENT DOCUMENTS

| | | | | |
|---|---|---|---|---|
| 3,041,036 | A * | 6/1962 | McFarland, Jr. | 251/171 |
| 3,226,080 | A * | 12/1965 | Lowrey | 251/309 |
| 3,276,737 | A * | 10/1966 | Koutnik | 251/171 |
| 3,656,711 | A * | 4/1972 | Toelke | 251/151 |
| 3,940,107 | A * | 2/1976 | Allenbaugh, Jr. | 251/297 |
| 4,285,886 | A * | 8/1981 | Delfino | 261/30 |
| 4,715,997 | A * | 12/1987 | Boone | 261/142 |
| 5,232,201 | A * | 8/1993 | Spears et al. | 251/315.01 |
| 5,551,467 | A * | 9/1996 | Booth et al. | 137/1 |
| 6,220,566 | B1 * | 4/2001 | Miller | 251/58 |
| 6,425,571 | B1 * | 7/2002 | Schadewald et al. | 251/315.13 |
| 6,561,160 | B2 * | 5/2003 | Suzuki et al. | 123/337 |
| 6,591,859 | B2 * | 7/2003 | Shih | 137/375 |
| 2003/0193036 | A1 * | 10/2003 | Mike | 251/315.01 |

FOREIGN PATENT DOCUMENTS

| | | | | |
|---|---|---|---|---|
| GB | 2062809 | A * | 5/1981 | 251/315.05 |
| JP | 60-201171 | A * | 10/1985 | 251/315.01 |

* cited by examiner

*Primary Examiner*—Richard L Chiesa

(57) ABSTRACT

A valve for sealing a carburetor inlet of a first diameter, includes a valve element having a curved surface for sealing the inlet opening, and a through hole of substantially the first diameter extending through the valve element, and a translation mechanism for rotating the valve element between a first position wherein the curved surface completely seals the opening and a second position wherein the through hole aligns with the inlet allowing a free flow into the carburetor.

15 Claims, 6 Drawing Sheets

ANTI-BACK-STREAMING CARBURETOR VALVE

CROSS-REFERENCE TO RELATED APPLICATIONS

The present invention claims priority to U.S. provisional patent application Ser. No. 60/658,999 filed on Mar. 4, 2005.

BACKGROUND OF THE INVENTION

1. Field of the Invention

The present invention is in the field of the automotive industry and pertains particularly the area of carburetor devices for reducing emissions, and pertains more particularly to devices and methods for preventing gasoline fumes from leaving a carburetor when the associated vehicle is stalled.

2. Discussion of the State of the Art

It is well known that vehicle exhaust emissions from internal combustion engines and fumes from raw gasoline and other combustible fuels are a source of pollution and environmental concern. Regulations exist and are continually enhanced and upgraded by various governmental sources, from local to national level.

One area of growing concern is the area of evaporation of raw fuel, such as gasoline, from vehicle fuel systems. These emissions can be either from the storage tanks used for carrying fuel with a vehicle, or from fuel delivery systems used to deliver fuel to a carburetor device for mixing with air and providing to a an internal combustion engine. In the latter case, when a vehicle is in use, air is typically drawn from outside into a carburetor and mixed with fuel, such as gasoline. The flow of air into the carburetor in this instance effectively blocks back streaming of fuel vapor from the carburetor into the surrounding air. When the same vehicle is stopped, however, and the engine is off, raw fuel still in the carburetor will typically evaporate and back-stream from the carburetor into the local environment. The present invention deals with this back streaming, and the invention taught in one embodiment described below effectively ends back-streaming of fuel under these circumstances.

SUMMARY OF THE INVENTION

A valve for sealing a carburetor inlet of a first diameter is provided and includes a valve element having a curved surface for sealing the inlet opening, and a through hole of substantially the first diameter extending through the valve element, and a translation mechanism for rotating the valve element between a first position wherein the curved surface completely seals the opening and a second position wherein the through hole aligns with the inlet allowing a free flow into the carburetor. In one embodiment, the valve element is molded of a polymer material. In another embodiment, the valve element is cast from a metal.

In a preferred embodiment, the through hole is tapered out from the first diameter to form a second diameter at the valve end opposite the first diameter. Also in a preferred embodiment, the valve further includes a pair of diametrically opposed shaft extensions for facilitating intercommunication between the valve element and the translation mechanism. In one embodiment, the translation mechanism includes a solenoid and a linkage connecting a rotable shaft on the solenoid to a shaft extension of the valve element.

According to another aspect of the present invention an air filter device is provided and includes a base plate, a filter housing, and a valve for sealing a carburetor inlet of a first diameter, the valve including a valve element having a curved surface for sealing the inlet opening, and a through hole of substantially the first diameter extending through the valve element and a translation mechanism for rotating the valve element between a first position wherein the curved surface completely seals the opening and a second position wherein the through hole aligns with the inlet allowing a free flow into the carburetor. In one embodiment, the air filter device has a dome feature for providing interior space for the valve to operate.

According to another aspect of the invention, a method is provided for preventing backflow of fuel vapor from an inlet opening of a first diameter in a carburetor. The method includes steps of (a) fashioning a valve element having a curved surface for sealing the inlet opening, and a through hole of substantially the first diameter extending through the valve element, (b) mounting the valve element rotably so that rotation to a first position causes the curved surface to block the inlet, and rotation to a second position aligns the through hole with the inlet, and (c) rotating the valve element to the first position to prevent backflow of fuel, and to the second position to allow air to flow into the inlet.

In one aspect, in step (a), the valve element is molded from a polymer material. In another aspect, in step (a), the valve element is cast from a metal. In one preferred aspect, in step (a), the through hole is tapered out from the first diameter to form a second diameter at the opposing side the through hole. Also in a preferred aspect, in step (b), the valve element includes diametrically opposed shaft extensions protruding there from, the extensions functioning as mounting arms and the rotation is about the axis formed by the shaft extensions. In one embodiment, in step (c), rotating of the valve element occurs to the first position when the engine is not running and to the second position when the engine is started.

According to another aspect of the invention, a valve assembly connected to a carburetion system is provided. The valve assembly includes a housing having at least one outlet opening of a first diameter leading to the carburetion system, a valve, the valve including a valve element having a curved surface for sealing the outlet opening, and a through hole of substantially the first diameter extending through the valve element, and a translation mechanism for rotating the valve element between a first position wherein the curved surface completely seals the opening and a second position wherein the through hole aligns with the outlet allowing a free flow toward the carburetion system.

In one embodiment, the housing is fashioned of aluminum or a polymer material. In a preferred embodiment, the through hole is tapered out from the first diameter to form a second diameter at the valve end opposite the first diameter. In one embodiment, the valve assembly further includes an inlet opening connected via flexible hose to an air filtration device. In a preferred embodiment, an elongated hose connects the outlet opening on the valve assembly to an inlet opening on the carburetion system. In preferred embodiments, the translation mechanism includes a solenoid and a linkage connecting a rotable shaft on the solenoid to a shaft extension of the valve element. In a preferred embodiment where there is connection to an air filtration device, the valve assembly is disposed between the carburetion system and the air filtration device, the components connected together by flexible hose forming a carburetor air intake system that is valve-controlled to prevent backflow of vapors from the carburetor into the valve assembly.

BRIEF DESCRIPTION OF THE DRAWING FIGURES

DETAILED DESCRIPTION

Figure 1A:
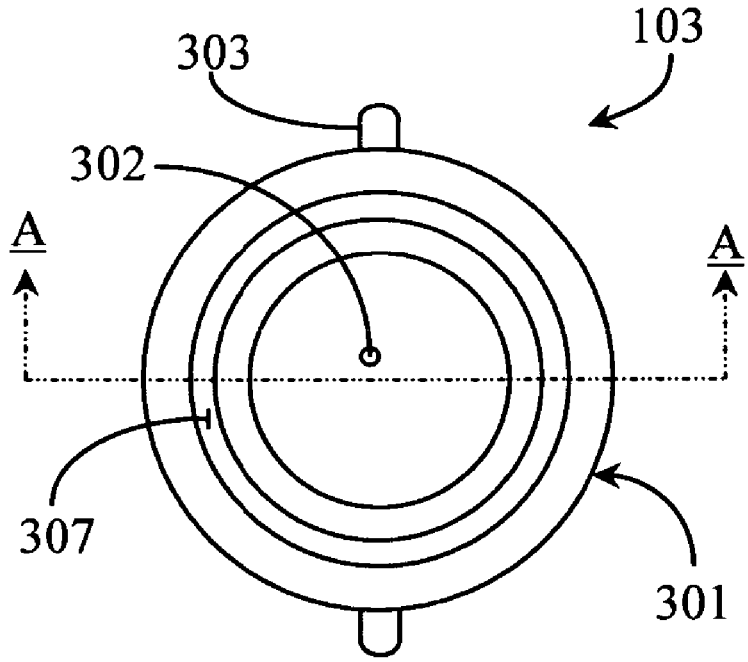
FIG. 1A is a front view of an anti-back-streaming valve for a carburetion system according to an embodiment of the present invention.

FIG. 1A is a front view of an anti-back-streaming valve 103 for a carburetion system according to an embodiment of the present invention. Valve 103 may be molded from a suitably dense fuel and additive resistant polymer like nylon or Delran. In one embodiment, valve 103 may be cast of aluminum, brass, or other suitable metals that are corrosion resistant and that may exhibit a smooth surface finish, illustrated herein as surface 301 after casting and polishing so as to enable sealing along that surface, which is substantially spherical in a preferred embodiment of the invention.

Valve 103 has an opening 302 provided there through and adapted as a valve opening for enabling intake of air into a carburetion system. Opening 302 is larger in diameter at one end of valve 103 than at the opposite end forming a conical shape functioning as a venturi whereby the larger diameter portion of opening 302 faces away from the carburetor. In one embodiment, opening 302 has a peripheral chamfer 307 provided at one end of the opening, however, this is not specifically required in order to practice the present invention. In one embodiment, valve 103 has shaft extensions 303 (one on each opposite side) provided thereon. Shaft extensions 303 are diametrically opposed sharing the same axis and extend substantially perpendicular from surface 301 to a position suitable for mounting in a bracket-type mounting arrangement described later in this specification. Extensions 303 may be formed contiguously with valve 103 in molding or casting depending at least in part of cost considerations and structural design considerations. Shaft extensions 303 protrude out from surface 301 of valve 103 but do not extend into opening 302.

Figure 1B:
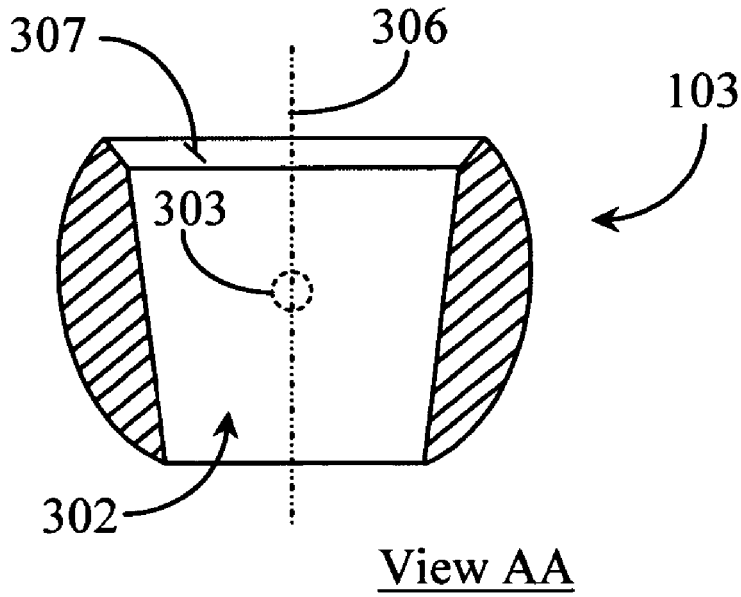
FIG. 1B is a sectioned view of the valve of FIG. 1A taken generally along the section line AA.

FIG. 1B is a sectioned view of valve 103 of FIG. 1A taken generally along the section line AA. Valve 103 is illustrated in section in this view to better illustrate opening 302 as formed there through. Opening 302 has an approximate 7-degree venturi angle projected inward from the major diameter edge of the opening. Other angles may be used in place of a 7-degree angle without departing from the spirit and scope of the present invention. The mentioned angle of inward taper is just an exemplary angle for producing a desired venturi effect for air entering a carburetion system enhanced with valve 103. An axis 306 defines the substantial centerline of opening 302. It is noted herein that with respect to an intake port of a carburetion system, valve 103 is uniquely caused to rotate such that opening 302 no longer communicates air into the carburetion system and surface 301 functions as a sealing agent over the intake port. More detail about operation of valve 103 is provided further below.

The overall major diameter of valve 103 may vary widely without departing from the spirit and scope of the present invention. In a preferred embodiment, the size of valve 103 will depend, at least in part, on the size of a port on a carburetion system that will be enhanced by the valve in accordance with the present invention. Similarly, the dimensions of opening 302 may also vary accordingly.

Figure 1C:
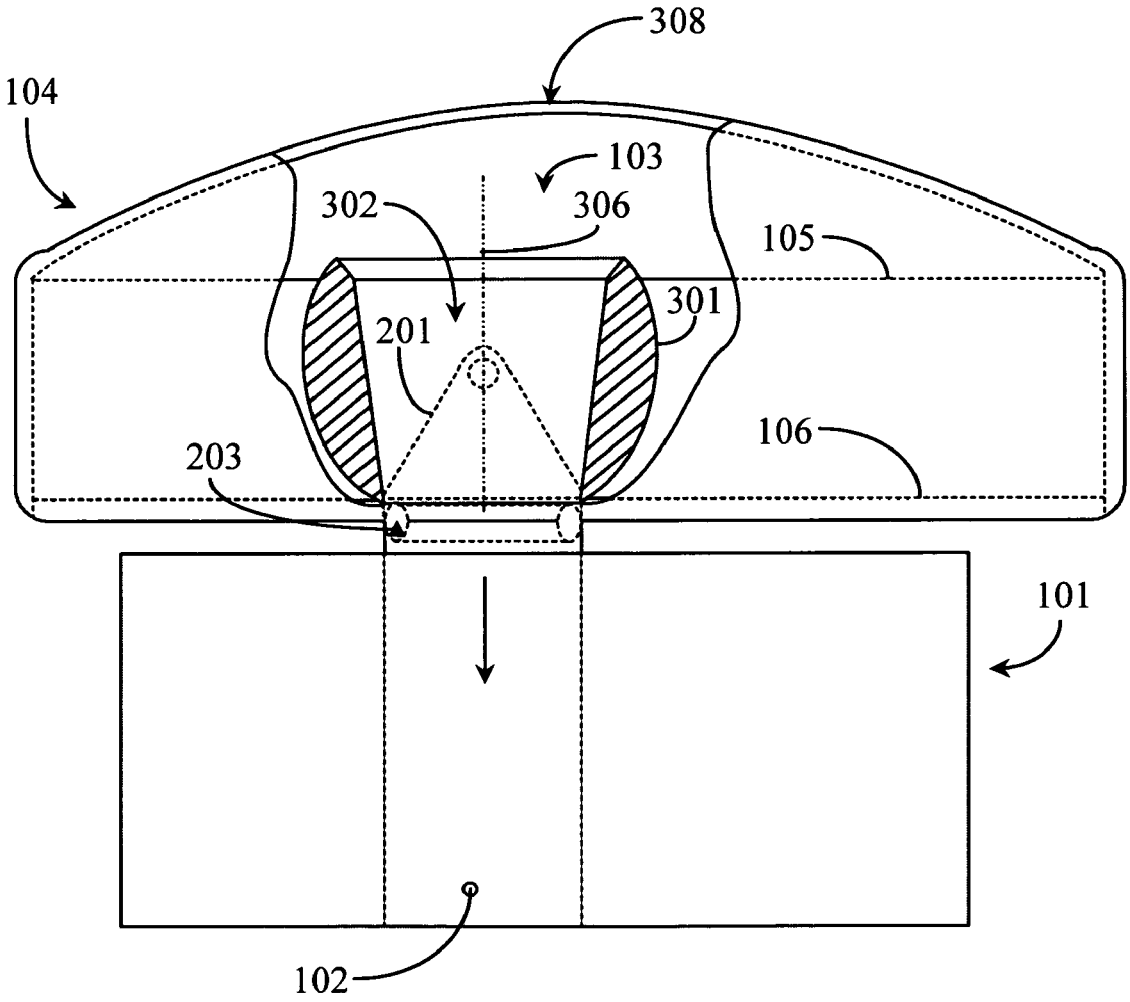
FIG. 1C is an elevation view of a carburetion system enhanced with the anti-back streaming valve of FIG. 1A and FIG. 1B in vertical position during active air intake according to an embodiment of the present invention.

FIG. 1C is an elevation view of a carburetion system enhanced with anti-back streaming valve 103 of FIG. 1A and FIG. 1B cause to assume a vertical position during active air intake according to an embodiment of the present invention. The carburetion system illustrated herein includes a fuel carburetion device, or carburetor 101. Carburetor 101 may be any type of carburetion device such as are known in the art including single barrel, two-barrel, or four barrel type devices. Carburetor 101 may exhibit many different physical features, forms, and shapes without departing from the spirit and scope of the present invention. The inventor logically illustrates carburetor 101 as a block for simplicity and clarity. The only requirement of carburetor 101 is that it has at least one port that may be blocked by the valve of the present invention. Carburetors with more than one port may be equipped with more than one valve 103 accordingly.

Carburetor 101 has a fuel/air intake port 102, which extends vertically up from the surface of carburetor 101 through a base, illustrated herein as base 106, of an air filter container or canister 104. Container 104 may be typical of any type of canister that may contain an air filter whereby the combination is fitted over a carburetion port or ports of a carburetion system for the purpose of insuring that clean air void of particulate enters the carburetion system. In typical art, such canister/filter combinations are annular in plan view, meaning that the canister or container is annular and the filter is annular or in the shape of a ring. However, the present invention may be used with filter arrangements of other forms or shapes without departing from the spirit and scope of the present invention.

The only requirement of container 104 is that it has enough internal space and height for facilitating rotation of valve 103 from vertical to a rotated position for blocking intake port 103 of carburetor 101. In this logical view, container 104 is positioned and mounted over port 102 of carburetor 101. An air filter 105 is illustrated as included within container 104. In this case, the entire housing of container 104 may be detached from base 106. In other embodiments, the housing includes the base and the container has a detachable lid. There are many known configurations. In this case, container 104 has a protruding outward dome 308 formed therein for facilitating rotational movement of valve 103 in operation in this example. Many known filter containers though, have enough space and height within the container to facilitate valve 103 without modification such as doming the top to enable more internal room. Filter 105 is a standard cartridge type filter element as is known in the art.

Container 104 is partially cut away in this example to illustrate valve 103 installed and in section view similar to the view AA of FIG. 1B. Axis 306 is substantially vertical or perpendicular indicating that valve 103 is actively communicating air into intake port 102 of carburetor 101, presumable while carburetor 101 is actively performing carburetion. Therefore, in this case valve 103 is seated over port 102 and against ring seal or gasket 203 whereby the intake is completely open for receiving air through air filtering system 104.

Container base 106 has a pair mounting brackets 201 mounted thereto in a strategic spaced-apart manner as to enable mounting of valve 103 in a rotable fashion via shaft extensions 303 described further above. Brackets 201 each have receiving openings provided thereto and adapted to receive valve 103 via the shaft extensions (303) on the valve. In this example, the rear bracket 201 is visible as a hidden boundary. The front bracket 201 is cut away in this view. Seal or gasket 203 may be any pliable, fuel-resistant rubber or other pliable gasket material. In a preferred embodiment, seal 203 is memory resilient such that the bottom portion of valve 103 defined as the minor diameter of opening 302 may form a leak tight seal there against for communicating air into the carburetion system. And, such that when valve 103 is caused to rotate, the spherical surface 301 of valve 103 may form a leak tight seal against seal 203 effectively preventing back streaming of fuel from the carburetor. In this view, valve 103 is vertical and air is passing into carburetor 101 according to the direction of the arrow placed within intake port 102.

Figure 1D:
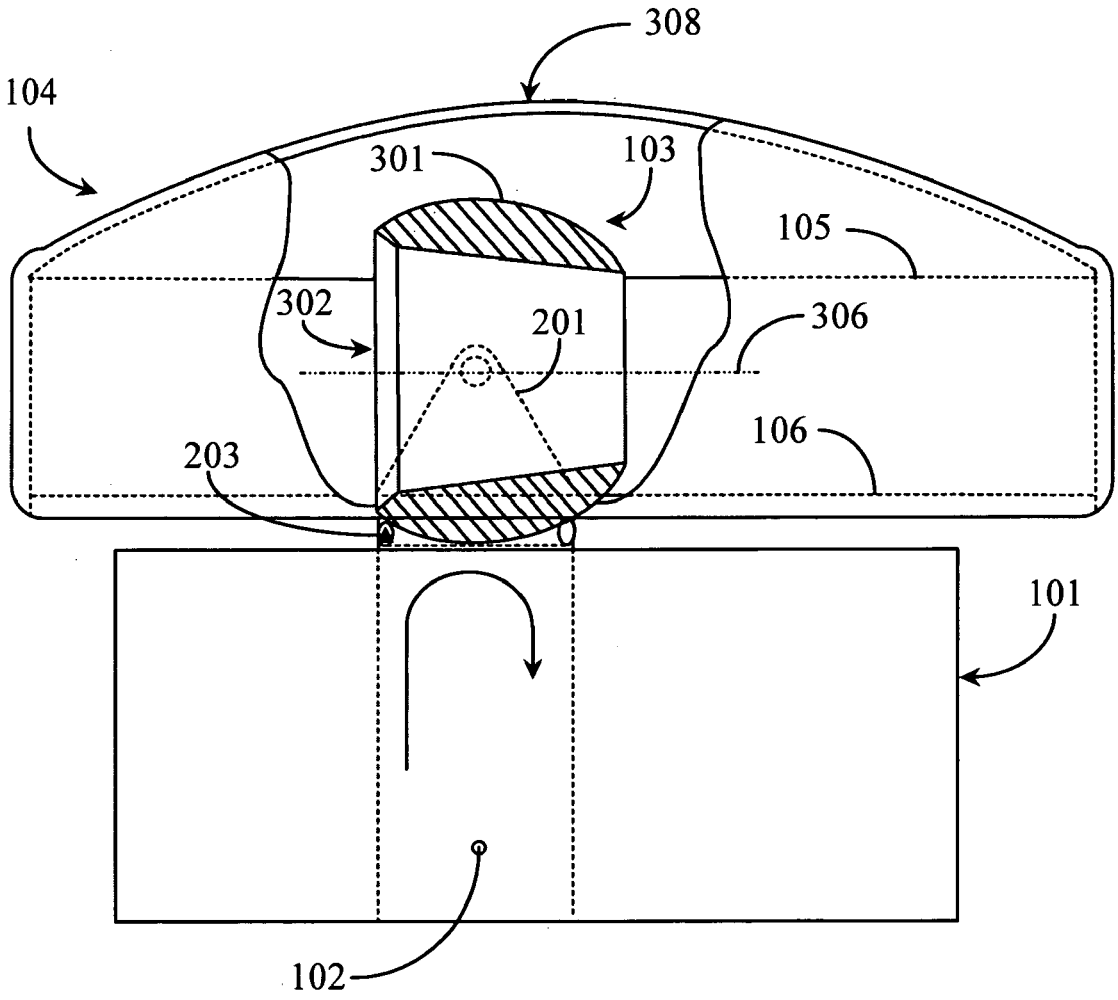
FIG. 1D is an elevation view of the system of FIG. 1C illustrating the anti-back streaming valve rotated to prevent back streaming of fuel according to an embodiment of the present invention.

FIG. 1D is an elevation view of the system of FIG. 1C illustrating anti-back streaming valve 103 rotated to prevent back streaming of fuel according to an embodiment of the present invention. In this view, valve 103 is rotated to approximately 90 degrees off vertical as illustrated by axis 306. Valve 103 in this position blocks port 102 of carburetor 101. via surface 301 of valve 103 sealing against seal or gasket 203. It is noted herein that in a preferred embodiment this state exists whenever an engine system utilizing the carburetor is not running or is powered off. No air may pass from the filtering system into the intake port and no gasoline or vapors from the carburetion system may back stream into the filtering system potentially escaping into the environment. This is illustrated by a curved directional arrow-placed in port 102 showing blockage of the normal back stream of vapors.

In one embodiment of the present invention, a solenoid system with linkage (not illustrated) is provided and may be mounted to base 106 and may connect to valve 103 at one of shaft extensions 103 where it protrudes through the opening in bracket 201. Such a system will be described further below. The spherical design-of valve 301 in combination with the resiliency of seal 203 is key to enrabling a repetitive seal in either the vertical or horizontal position of the valve in relation to port 102. The design and clearances are such that the rotational movement happens about the axis forming the shaft extensions wherein transition from vertical seal to horizontal seal happens with minimal frictional forces against seal 203. The resiliency of seal 203 functions to take up any slack in tolerance resulting from the "lune" formed in the bottom portion of spherical valve 103 by opening 302. In one embodiment, brackets 201 have a slot for receiving shaft extension 303 instead of a hole. In this case, the mounting may be a spring mount that urges valve 103 in a downward direction, the range of which may be defined in the slot dimensioning on each bracket 201. The springs may be housed in the brackets themselves. There are many possibilities.

Figure 2:
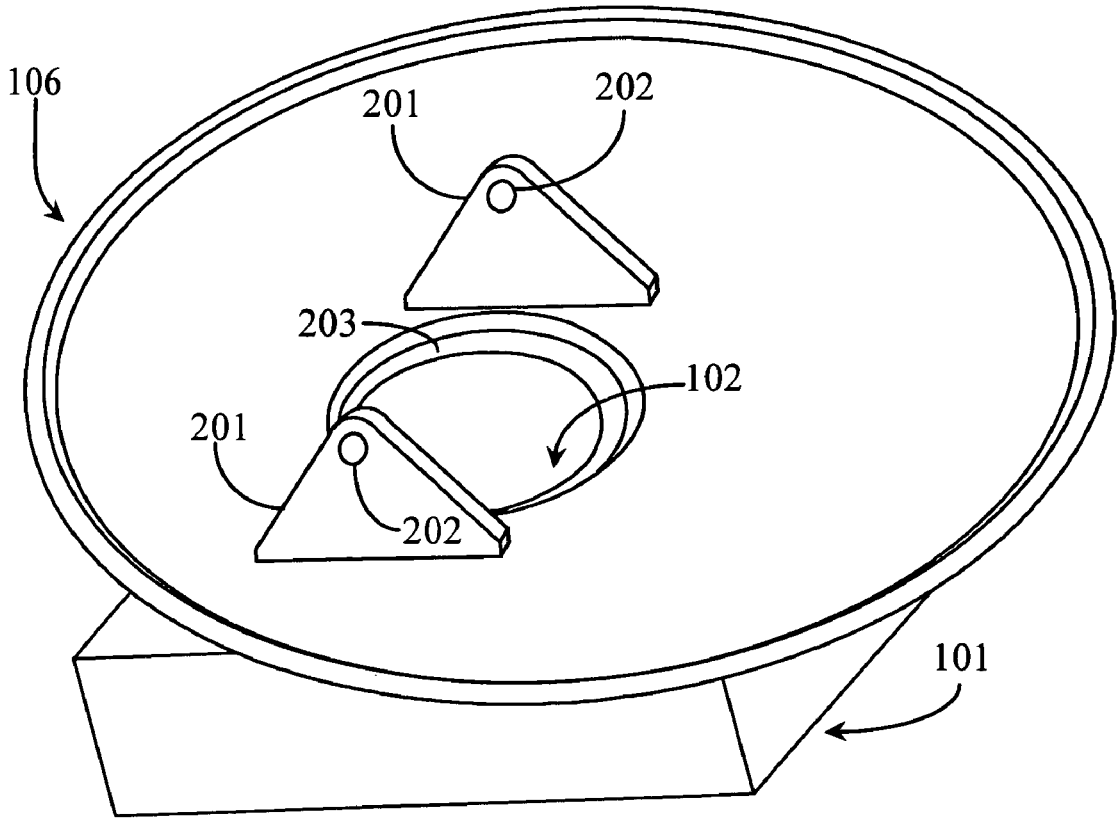
FIG. 2 is a perspective view of the system of FIG. 1D with the air canister, filter and valve removed to illustrated the mounting brackets and the carburetor inlet for clarity.

FIG. 2 is a perspective view of the system of FIG. 1D with the air filter container 104, filter 105 and valve 103 removed to illustrate mounting brackets 201 and the carburetor inlet 102 for clarity. In this view base 106 on carburetor 101, with inlet 102 substantially centered, and a pair of mounting brackets 201 attached to the base are shown in perspective. Inlet 102 exhibits circular gasket 203 around the periphery of the inlet opening for sealing to the valve element as described above. Brackets 201 are for rotably mounting valve 103 at openings 202, to cause the valve element to rotate about an axis through cylindrical openings 202.

Carburetor 101 is illustrated as a featureless block in this example for logical representation only. It is clear that carburetor 101 in actual practice may exhibit a variety of features, shapes, and forms none of which would be relevant to the present invention. The only requirement of carburetor 101 is that it has at least one intake port analogous to port 102 that is accessible through the air cleaning canister base. However, accessing carburetor 101 through the base of an air filtration canister should not be construed as a limitation of the invention as it is possible to adapt the valve and mounting apparatus to fit on the carburetor housing itself provided that modifications are made to the base of the canister to accommodate the apparatus and to enable filtered intake into the port. In a preferred embodiment, the apparatus is provided on the base of an air filter canister or container for convenience and practicality. Moreover, the apparatus may be packaged together with the "spec" or stock air cleaner apparatus used for the make of engine and the stock carburetion system of the engine. In this way, much convenience is afforded the user of the system of the invention.

Base 106 is illustrated with brackets 201 installed. Each bracket 201 has an opening 202 provided therein at strategic location for accepting valve 103 via shaft extensions 303. Openings 202 may be adapted to contain ring bearings (not illustrated) that may individually and freely rotate within each opening. The shaft extensions then may be adapted to seat into such rings by keyway design such that the shafts them selves cannot rotate within the rings. Using such a common design provides the opportunity to link at least one ring or shaft via linkage to a mechanism such as a solenoid, for example, for causing the desired rotation of valve 103. Openings 202 may be provided as slots of a specified dimension to allow vertical travel of valve 103 to a range defined by slot dimensioning to further aid in effective and repetitive sealing capability.

Figure 3:
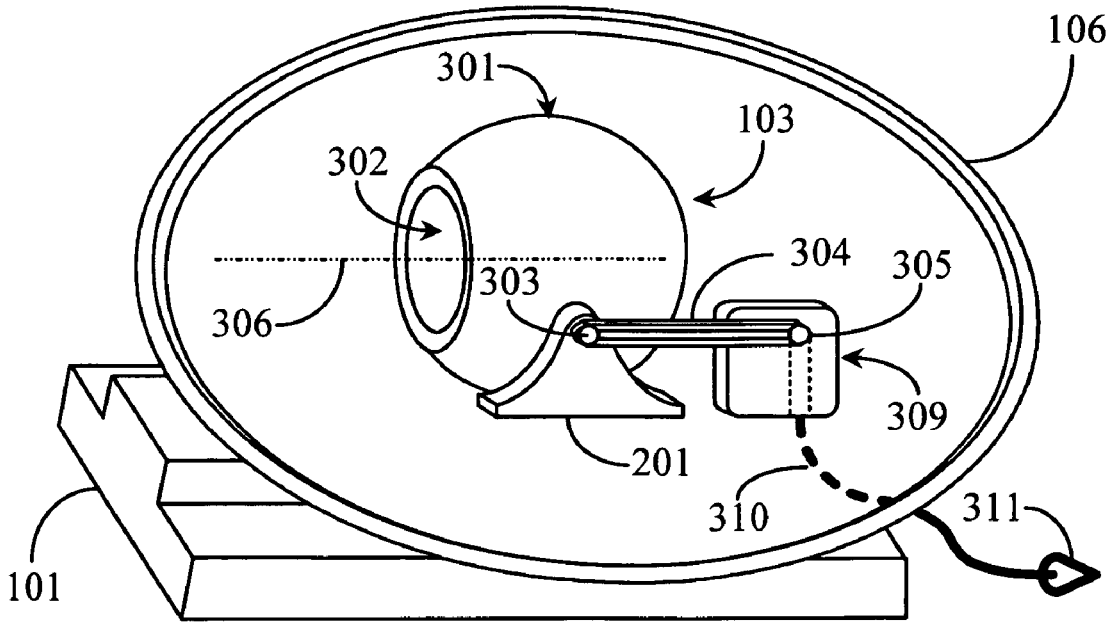
FIG. 3 is a perspective view of the system of FIG. 1D with the air canister and filter removed illustrating the anti-back streaming valve mounted and components for driving the valve according to an embodiment of the present invention.

FIG. 3 is a perspective view of the system of FIG. 1D with air canister 104 and filter 105 removed illustrating anti-back streaming valve 103 mounted and including components for driving the valve according to an embodiment of the present invention. In this view, carburetor 101 is again illustrated in a logical sense only. Base 106 has brackets 201 installed and valve 103 mounted there between via shaft extensions 303 through openings 202. The position of valve 103 in this example is horizontal as defined by axis 306 and as was illustrated further above with respect to FIG. 1D. Spherical surface of valve 301 is effectively blocking intake port 102 of carburetor 101 to prevent back streaming of fuel and fuel vapors. Opening 302 is visible to the right of center indicating a rotation in that particular direction. However, valve 103 may also be caused to rotate in the opposite direction without departing from the spirit and scope of the present invention.

In one embodiment that has been mentioned repetitively above, a linkage 304 is provided to connect to valve 103 at the shaft extension 303 where it protrudes from opening (202). Linkage 304 has connection at the opposite end to a horizontally presented, rotable shaft 305 extending from a solenoid-type device further having a vertical driving arm or shaft enclosed in a housing 309. Linkage 304 may "track" linearly in one direction or the other about the pair of shafts comprising shaft 303 and shaft 305. The vertical pivot or driver (illustrated as a dotted boundary) within housing 309 may rotate to a specified amount causing linkage 304 to track that amount facilitating controlled rotation such that valve 103 may be held in place or may be rotated to another position. Link 304 may be a rubber belt in one embodiment. In another embodiment, link 304 may be a pair of separate arms. In still another embodiment, link 304 may be metallic chain of sorts engaging teeth provided about the ends of shafts 303. In this way valve 103 is rotable in a limited sense, the range of rotation governed by the solenoid device.

In this example, solenoid device 309 has a power wire 310 culminating in a power plug 311 for connecting into the electrical wiring system of a vehicle or system utilizing the carburetion system. In a preferred example, when the system is powered off, the solenoid switches causing rotation of valve 103 to a substantially horizontal position. In one embodiment, the rotation amount is sufficient to cause the intake port to be completely sealed by surface 301 of valve 103. That amount may not require a full 90 degree rotation of valve 103. Therefore, valve 103 may be rotated in some embodiments, less than 90 degrees from vertical without departing from the spirit and scope of the present invention.

It will be apparent to one with skill in the art that valve 103 including a drive system may be entirely provided within an air filter container and may be adapted to work from within that container provided that the intake or intakes on the carburetion system make entry through the base of the container when the container is installed. In a preferred embodiment, the drive system has connection to the engine hot wire so that when starting the engine, valve 103 rotates to vertical to allow intake of air for normal carburetion. When the engine is shut off, the valve rotates off vertical to seal off the carburetor intake. A safety override measure may be provided in the event of an engine stall in one embodiment whereby if the engine stalls while the vehicle is rolling then the valve would not rotate off of perpendicular so as to enable quick restarting while in motion. A movement sensor may be added to enable this embodiment. Other embodiments are possible without departing from the spirit and scope of the present invention. One alternative embodiment is described below.

Figure 4:
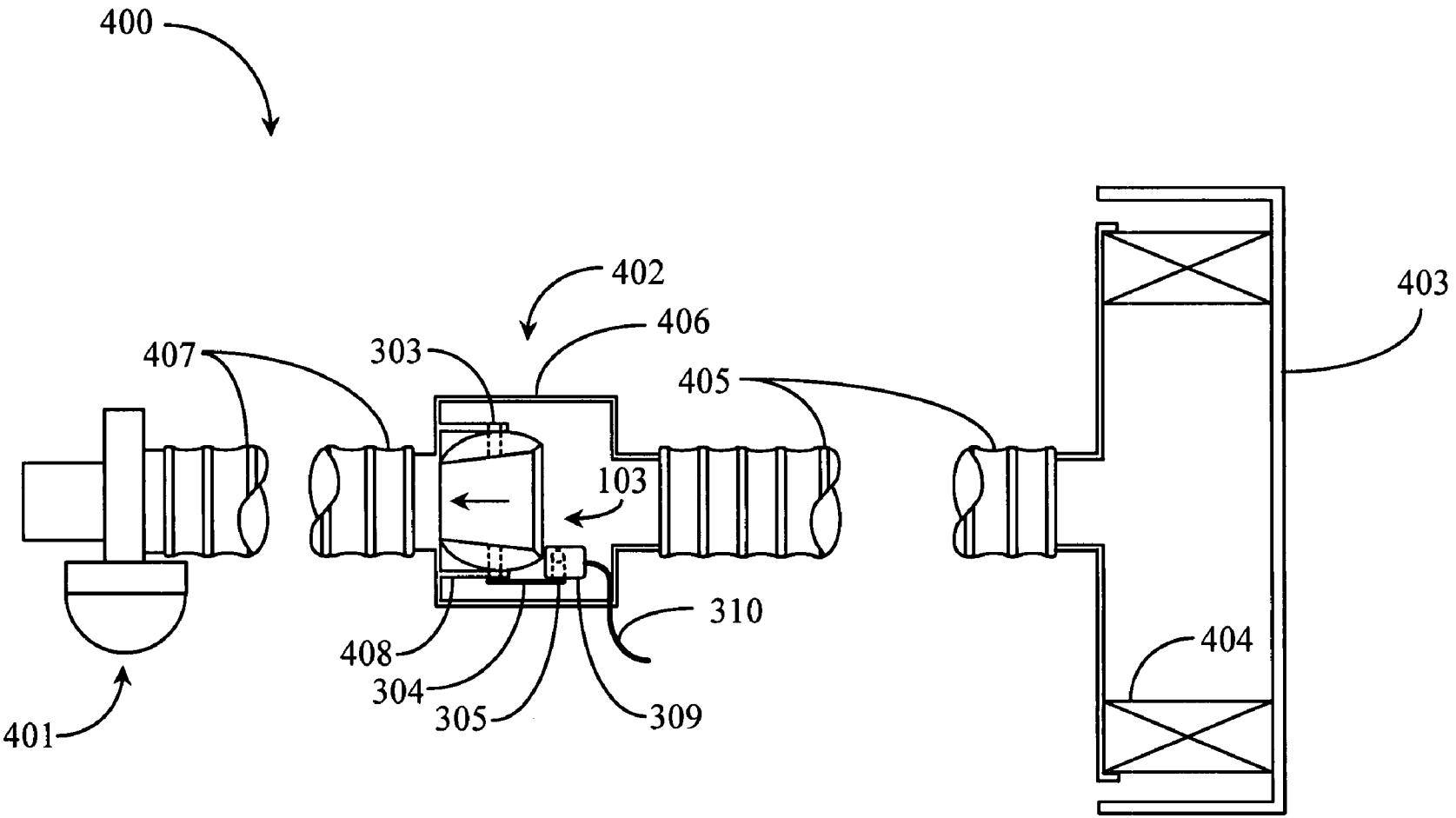
FIG. 4 is an elevation view of a carburetion system enhanced with the anti-back streaming valve of FIG. 1A and FIG. 1B according to another embodiment of the present invention.

FIG. 4 is an elevation view of a carburetion system 400 enhanced with anti-back streaming valve 103 of FIG. 1A and FIG. 1B according to another embodiment of the present invention. System 400 includes a carburetor 401, a remote air-filtering device 403 and a ball valve housing assembly 402. In this example, carburetor 401 has an air intake port that is connected via an elongated flexible hose 407 to ball valve housing assembly,402. Ball valve housing assembly 402 is in turn connected at one ported end via an elongated flexible hose to air filtering device 403. Air filtering device 403 includes air filter cartridge 404 and is otherwise similar to the air-filtering device described further above with the exception that it is mounted in a remote location from the carburetor.

The method of the present invention is performed within ball valve assembly housing 402. Assembly 402 comprises a solid and mountable housing 406 having two opposing ports. Housing 406 may be constructed of aluminum, metal, or a durable polymer. Hose 405 in the direction leading to air-filter device 403 connects to one open port of housing 406. This port remains open and has no valve mechanism associated with it. Hose 407 in the direction leading to carburetor 401 connects to the other port of housing 406. This port is valve controlled via anti-back streaming valve 103 in a similar fashion as was described previously. Housing 406 includes two brackets 408, which may be similar to or identical in design as brackets 201 described further above.

Brackets 408 are strategically spaced apart and provide a mounting location for valve 103 having extensions 303. In this respect, the mounting features and apparatus may be similar to or identical to that described with reference to base 106 of FIG. 3. A drive system including linkage 304 and sister shaft extension 305 as previously described above is also present in this example as are solenoid housing 309 and wiring 310. The only difference is that the drive system is mounted on the inner side of a back wall of housing 406 in a configuration that presents shaft 305 and linkage 304 in a position to mount with shaft extension 303 of valve 103.

Using flexible hose 407 and 405 allows mounting of air filter device 403 and ball valve assembly 402 in virtually any convenient location within an engine compartment. They do not have to be in any symmetrical arrangement with respect to the location of and orientation of carburetor 401 in order to practice the present invention. These features are illustrated in line in this example for clarity only.

This embodiment function in the same way as the previous embodiment described above. That is to say that valve 103 is caused to pivot to approximately 90 degrees about the axis formed by extension shafts 303. In this case, a flexible gasket (not illustrated) like gasket 203 described in FIG. 2 above, might be provided in a recess formed at the opening of the valve-controlled port on housing 402 in the same fashion as was provided in the intake port 102 of carburetor 101 described earlier.

When valve 103 is positioned so as to be sealed and in communication with the associated port of housing 406, then air for intake into carburetor 401 travels from air filter device 403, through hose 405, through housing 406 and valve 103, through hose 407 and into the intake at carburetor 401. When valve 103 is pivoted about the axis formed by shaft extensions 303 to block communication of air into the port, then no intake air passes beyond housing 406 and gasoline vapors or other pollutants are prevented form entering into housing 406 from the carburetor side of system 400.

It will be apparent to one with skill in the art of valve ports that the method and apparatus of the present invention may be used in carbureted vehicles such as cars, trucks, farm vehicles, construction vehicles, and the like. The invention may also be applied to other forms of carbureted engines such as those belonging to boats, motorcycles, lawn mowers, chain saws, all terrain vehicles, and so on. The only requirement of the invention is that the application includes a carburetor having at least one port for sealing. The presence of an air filtering canister or container is not specifically required in order to practice the present invention. The presence of an air filter mechanism simply provides one convenient mounting location for the valve assembly and the valve driving system and wiring. For example, in the described embodiment of FIG. 4, the valve assembly is entirely remote from any air-filtering device.

The present invention may be carried out using some of or all of the components illustrated herein without departing from the spirit and scope of the present invention. In light of the embodiments described herein and which are conceivable in application, the present invention should be given the broadest interpretation according to the claims. The present invention shall be limited only by the claims that follow.

What is claimed is:

1. A valve for sealing a carburetor inlet of a first diameter, comprising:

a valve element having a curved surface for sealing the inlet opening, and a through hole of substantially the first diameter extending through the valve element, the through hole tapered out from the first diameter to form a second diameter at the valve end opposite the first diameter; and a translation mechanism for rotating the valve element between a first position wherein the curved surface completely seals the opening and a second position wherein the through hole aligns with the inlet allowing a free flow into the carburetor; and a pair of diametrically opposed shaft extensions for facilitating intercommunication between the valve element and the translation mechanism;

wherein the translation mechanism includes a solenoid and a linkage connecting a rotable shaft on the solenoid to a shaft extension of the valve element.

2. The valve of claim 1, wherein the valve element is molded of a polymer material.

3. The valve of claim 1, wherein the valve element is cast from a metal.

4. A method for preventing backflow of fuel vapor from an inlet opening of a first diameter in a carburetor, comprising steps of:

(a) fashioning a valve element having a curved surface for sealing the inlet opening, and a through hole of substantially the first diameter extending through the valve element;

(b) mounting the valve element rotably so that rotation to a first position causes the curved surface to block the inlet, and rotation to a second position aligns the through hole with the inlet; and (c) rotating the valve element to the first position to prevent backflow of fuel, and to the second position to allow air to flow into the inlet.

5. The method of claim 4, wherein in step (a), the valve element is molded from a polymer material.

6. The method of claim 4, wherein in step (a), the valve element is cast from a metal.

7. The method of claim 4, wherein in step (a), the through hole is tapered out from the first diameter to form a second diameter at the opposing side the through hole.

8. The method of claim 4, wherein in step (b), the valve element includes diametrically opposed shaft extensions protruding there from, the extensions functioning as mounting arms and the rotation is about the axis formed by the shaft extensions.

9. The method of claim 4, wherein in step (c), rotating of the valve element occurs to the first position when the engine is not running and to the second position when the engine is started.

10. A valve assembly connected to a carburetion system comprising:

a housing having at least one outlet opening of a first diameter leading to the carburetion system;

a valve, the valve including a valve element having a curved surface for sealing the outlet opening, and a through hole of substantially the first diameter extending through the valve element; and a translation mechanism for rotating the valve element between a first position wherein the curved surface completely seals the opening and a second position wherein the through hole aligns with the outlet allowing a free flow toward the carburetion system.

11. The valve assembly of claim 10, wherein the housing is fashioned of aluminum or a polymer material.

12. The valve assembly of claim 10, wherein the through hole is tapered out from the first diameter to form a second diameter at the valve end opposite the first diameter.

13. The valve assembly of claim 10, further including an inlet opening connected via flexible hose to an air filtration device.

14. The valve assembly of claim 10, wherein an elongated hose connects the outlet opening on the valve assembly to an inlet opening on the carburetion system.

15. The valve assembly of claim 10, wherein the translation mechanism includes a solenoid and a linkage connecting a rotable shaft on the solenoid to a shaft extension of the valve element.

* * * * *